United States Patent [19]

Terakawa et al.

[11] Patent Number: 4,488,157

[45] Date of Patent: Dec. 11, 1984

[54] SLOT ARRAY ANTENNA ASSEMBLY

[75] Inventors: Takashige Terakawa, Yokohama; Noriyuki Akaba, Tokyo, both of Japan

[73] Assignee: Tokyo Keiki Company Limited, Tokyo, Japan

[21] Appl. No.: 350,739

[22] Filed: Feb. 22, 1982

[51] Int. Cl.[3] ..... H01Q 13/10

[52] U.S. Cl. ..... 343/771; 343/785

[58] Field of Search ..... 343/771, 785, 786

[56] References Cited

U.S. PATENT DOCUMENTS

| | | | |
|---|---|---|---|
| 2,730,717 | 1/1956 | Katchky et al. | 343/771 |
| 3,039,097 | 6/1962 | Strumwasser et al. | 343/771 |
| 3,146,449 | 8/1964 | Serge et al. | 343/771 |
| 3,234,558 | 2/1966 | Borgiotti | 343/771 |
| 3,496,568 | 2/1970 | Palumbo et al. | 343/771 |

*Primary Examiner*—Eli Lieberman

*Attorney, Agent, or Firm*—Fleit, Jacobson, Cohn & Price

[57] ABSTRACT

Described is an antenna structure which reduces the side lobe level of a slot array antenna of the type using a dielectric plate as a director mechanism. A slot radiator is mounted on the vertical side of a member composed of metal plates and having a C-shaped side sectional shape, and a pair of parallel dielectric plates are projected to extend in the direction of the open end of the C-shaped member. Also, a pair of metal pent roof plates are provided to spread upwardly and downwardly from the open end edges of the C-shaped member on the outer side of the dielectric plates. The metal pent roof plates serve as reflecting plates for the radiation power from the slot radiator and thus the side lobe level is reduced to a practical low level.

6 Claims, 13 Drawing Figures

SLOT ARRAY ANTENNA ASSEMBLY

BACKGROUND OF THE INVENTION

The present invention relates to a slot array antenna assembly employing a dielectric director mechanism which exhibits the most suitable structure when used as an antenna for marine radars or the like.

In the past, various methods have been proposed in which the vertical plane beamwidth of a slot array antenna is reduced by a dielectric material A typical of these methods is disclosed for example in U.S. Pat. No. 3,234,558. Considering the fact that not only these methods have not been extensively put in practical applications but also even the owner of the patent right of this patent has not realized the merchandizing of the method, the situation appears in a sense due to the fact that the operating principle of this patent was not grapsed sufficiently at the time of its filing. In other words, it is difficult for the method disclosed by the patent to form a beam that can be put in practical use and thus no reduction in the side lobe level is attained.

SUMMARY OF THE INVENTION

With a view to overcoming the foregoing deficiencies in the prior art, it is the primary object of this invention to provide an improved slot array antenna assembly in which the previously proposed structure effectively utilizing a dielectric plate as a director mechanism is further provided with a pair of metal pent roof plates or flared reflecting plates and the side lobe level is reduced to a usable level, thereby overcoming the deficiencies in the prior art and ensuring reduced size and weight and improved performance.

Thus, a slot array antenna assembly provided in accordance with the present invention features an improved structure comprising a member composed of metal wall plates and having a C-shaped side sectional shape, a slot radiator mounted on the vertical side of the C-shaped member, a pair of parallel dielectric plates projected to extend along the two upper and lower parallel sides of the C-shaped member in the direction of the open end thereof, the dielectric plates having a plate thickness of less than one twentieth of a working wavelength, and a pair of metal pent roof plates connected to the open end edges of the C-shaped member to respectively open out upwardly and downwardly. The metal pent roof plates are either plane plates or cylindrical curved plates and they open out two-dimensionally or curvedly from the open end edges of the C-shaped member on the outer side of the pair of parallel dielectric plates.

With the slot array antenna assembly of this invention, the side formed by the C-shaped member and the metal pent roof plates may be covered with metal blocks or plate materials, one for each radiator element, so as to provide a partition wall composed of the metal blocks or plate materials.

Further, with the slot array antenna assembly of the invention, the space between the pair of parallel dielectric plates may be filled with a foamed dielectric material so as to prevent any variation of the distance between the dielectric plates and also to improve the mechanical strength. In this case, the wedge-shaped spaces between the metal pent roof plates and the dielectric plates may also be filled with foamed material to provide a contour which when viewed from the sides smoothly connects the outer surfaces of the pair of parallel dielectric plates with the forward end edges of the metal pent roof plates and also the entire structure may be covered from the outside with a thin sheet of dielectric material, thereby further improving the mechanical strength and the weathering resistance of the antenna assembly.

The above and other objects and features of this invention will become more apparent from the following detailed description of preferred embodiments taken in conjunction with the accompanying drawings.

DESCRIPTION OF THE PREFERRED EMBODIMENTS

Figure 1:
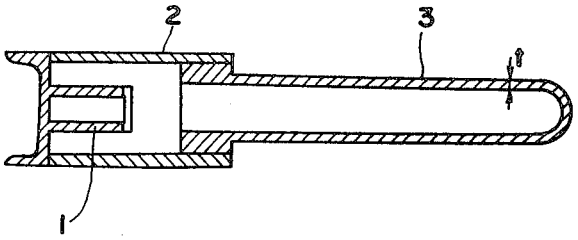
FIG. 1 PRIOR ART
FIG. 1 is a side sectional view of a slot array antenna assembly which has heretofore been proposed.

The present invention will now be described in greater detail with reference to the accompanying drawings. FIG. 1 is a side sectional view of a previously proposed slot array antenna assembly.

In FIG. 1, numeral 1 designates a slot waveguide which serves as a radiator and it comprises a so-called shunt edge type slot waveguide in which the small surface of the rectangular waveguide is formed with a number of slots serving as radiator elements. Numeral 2 designates a member composed of metal wall plates and having a C-shaped side section, and the slot waveguide 1 is mounted on the vertical side of the C-shaped member 2. The member 2 performs a function such that the electromagnetic waves radiated from the slot array of the slot waveguide 1 are directed in one direction. Numeral 3 designates a dielectric director for further converging the unidirectional electromagnetic waves and the plate thickness of its dielectric plate is indicated as t. The slot array antenna assembly of this conventional structure has many disadvantages from the practical point of view. The main points of these disadvantages will now be described. The first disadvantage is the fact that there must be a limitation to the plate thickness t of the dielectric material. In other words, generally the thickness must be less than about one twentieth of the working wavelength. The reason is that of the radiation power directed toward the outside from the open end of the C-shaped member 2, those components which propagate within the plate thickness t of the dielectric material deteriorate the radiation pattern. And greater the plate thickness t, greater will be the power propagating within the plate thickness with the resulting greater deterioration of the radiation pattern. However, where the plate thickness t is less than about one twentieth of the working wavelength, there will be no problem from the practical point of view. The second disadvantage is the improper shape of the dielectric director 3. It is presumed that the forward end of the director 3 is bent to have a circular side sectional shape with the intention of ensuring smooth propagation of the radiation power into space or ensuring a matched condition. With this shape, however, while the effect on the radiation pattern will be reduced and no problem will be caused if the length of the parallel portions of the dielectric material is great, if the length of the parallel portions is small, a large portion of the radiation power reaches the curved portion and this power portion is subjected to undesired reflection thereby causing the radiation pattern to deviate from the desired shape. The third disadvantage is the fact that the spacing between the two dielectric portions is excessively small as shown in FIG. 1. This is considered to be a natural consequence of bearing in mind the maximum possible reduction of the side lobe when using the antenna assembly in the actual applications as will be explained later. If the distance between the dielectric portions is reduced extremely as shown in FIG. 1, the dielectric director 3 closes the open end of the C-shaped member 2 and this has the effect of increasing the reflected component of the radiation power from the slot waveguide 1. The presence of this reflected power essentially affects the radiation impedance of the slots so that not only the frequency band width of the slots is reduced but also the variation in the frequency characteristic of the resonance characteristic of the slot impedance is increased and the phase front of the radiator element array is disturbed, thus deteriorating the radiation pattern. Since the slot array antenna assembly of the conventional structure has many disadvantages as mentioned so far, it has not been put in practical use.

Figure 2:
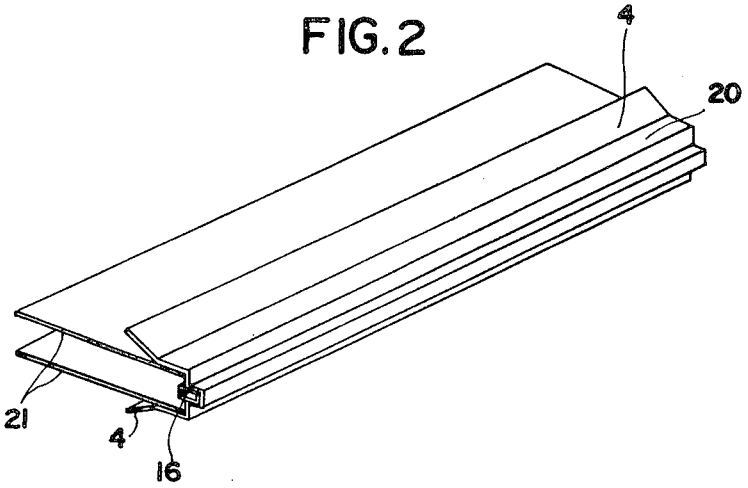
FIG. 2 is a perspective view showing the external appearance of an embodiment of a slot array antenna assembly according to the invention.
Figure 3:
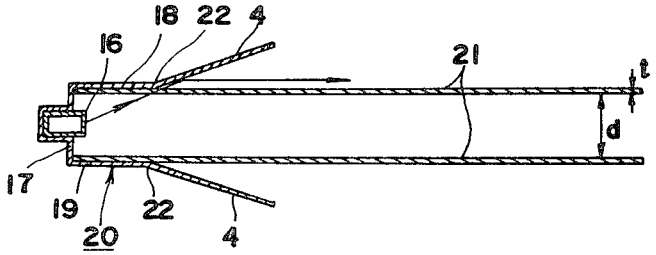
FIG. 3 is a side sectional view of FIG. 2.
Figure 4:
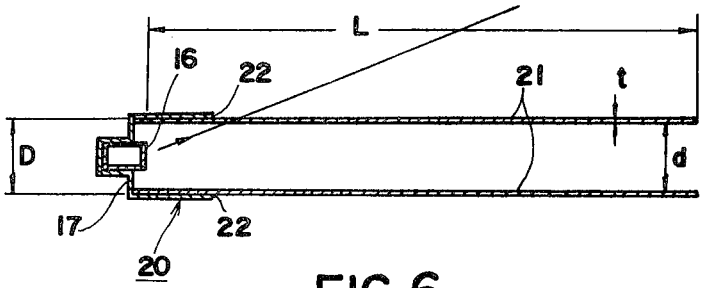
FIG. 4 is a side sectional view of FIG. 2 with the metal pent roof plates being removed.
Figure 6:
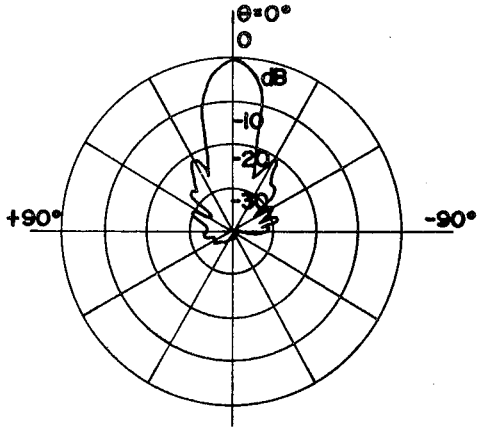
FIGS. 5*a* to 5*e* and FIG. 6 are characteristic diagrams showing the actually measured radiation patterns of the antenna assembly of the invention.

FIG. 2 shows an embodiment of a slot array antenna assembly according to the invention. FIG. 3 is a side sectional view of the embodiment shown in FIG. 2. In FIGS. 2 and 3, numeral 16 designates a slot waveguide which serves as a radiator, and 20 a member composed of metal wall plates and having a C-shaped side sectional shape with the slot waveguide 16 mounted on a vertical side 17 of the C-shaped member 20. The member 20 has the function of directing the radiation power from the slot array of the slot waveguide 16 in one direction. Numeral 21 designates a pair of parallel dielectric plates which are arranged respectively along two parallel sides 18 and 19 of the C-shaped member 20 and having a plate thickness of less than about one twentieth of the working wavelength. The dielectric plates 21 are projected to extend in the direction of the open end of the C-shaped member 20 and they serve the function of further converging the radiation power in this direction. Numeral 4 designates a pair of plane metal pent roof plates or flared relfecting plates arranged respectively to open out upwardly and downwardly from open end edges 22 of the C-shaped member 20 and they are connected to the metal wall plates of the C-shaped member 20 at the open end edges 22. The metal pent roof plates 4 constituting a principal part of this invention serve as reflecting plates for the radiation power from the slot waveguide 16 and have the function of reducing the side lobe level of the radiation pattern to the usable level. The plate thickness of the dielectric plates 21 is represented as t and the distance therebetween is represented as d. FIG. 4 is a side sectional view of FIG. 3 with the metal pent roof plates 4 being removed. In FIG. 4, L represents the length of the dielectric plates 21 projected to extend toward the open end of the C-shaped member 20, and D represents the length of the opening of the C-shaped member 20. FIGS. 5*a* to 5*e* and FIG. 6 are characteristic diagrams showing the actually measured radiation patterns of the antenna assembly according to the invention. The remarkable effects of the present invention will now be described in reference to FIGS. 5*a* to 5*e* showing the actually measured radiation patterns of the antenna assembly shown in FIG. 4 (without the metal pent roof plates 4) and FIG. 6 showing the actually measured radiation pattern of the antenna assembly of FIG. 3 which is provided with the metal pent roof plates 4.

Figure 7:
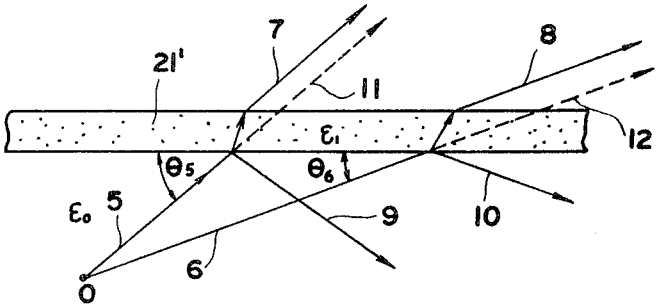
FIG. 7 is a diagram useful for explaining the operating principle constituting the basis of the invention.
Figure 5A:
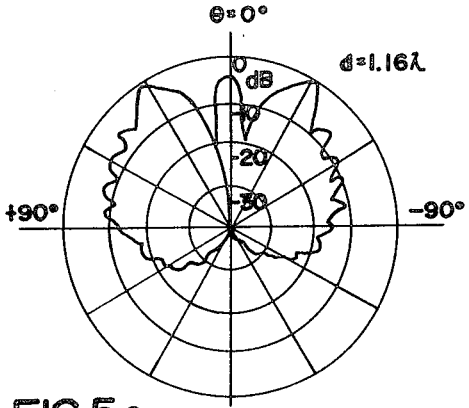
Figure 5B:
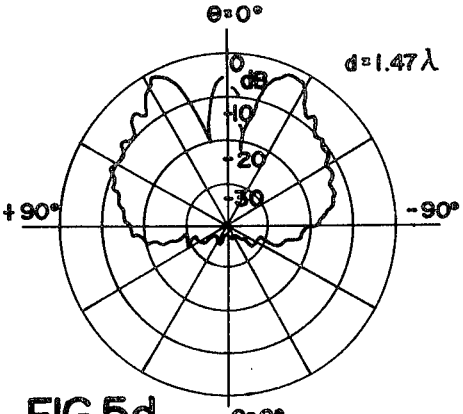
Figure 5C:
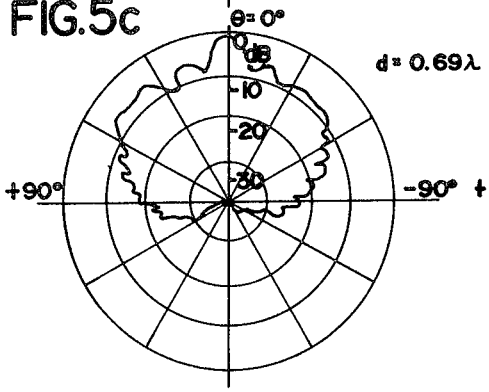
Figure 5D:
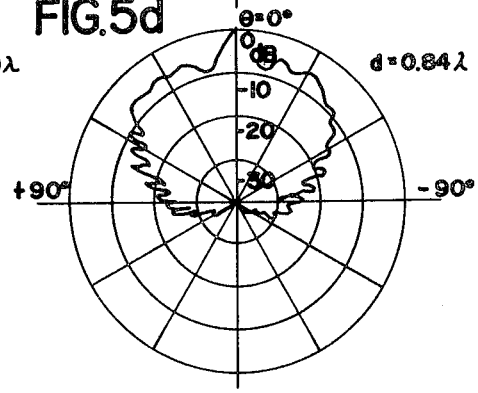
Figure 5E:
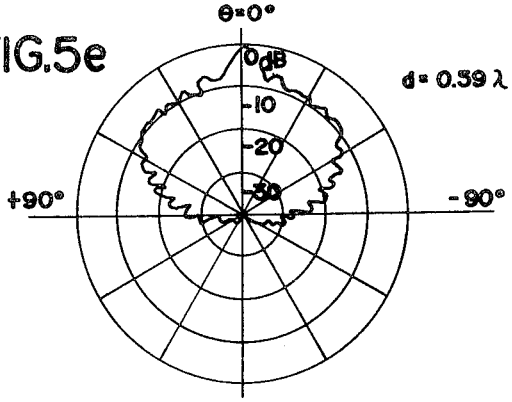

Referring first to FIGS. 5*a* to 5*e*, there are illustrated the actually measured radiation patterns with the length L of the dielectric plates 21 held constant at $L=6\lambda$ and varying the distance d between the plates 21 to $d=1.16\lambda$ (FIG. 5*a*), $d=1.47\lambda$ (FIG. 5*b*), $d=0.69\lambda$ (FIG. 5*c*), $d=0.84\lambda$ (FIG. 5*d*) and $d=0.59\lambda$ (FIG. 5*e*), respectively. The plate thickness t of the dielectric plates is about $0.05\lambda$. Here, $\lambda$ represents the working wavelength. These radiation patterns are indicative of the characteristics within the same plane as the plane of FIG. 4 and the direction of $\theta=0°$ is that direction in which the length L of the dielectric plates 21 is measured or the direction which is perpendicular to the pipe axis of the slot waveguide 16 and parallel to the dielectric plates 21. With a slot array antenna of the type shown in FIG. 4, by reducing the distance d between the dielectric plates 21, it is possible to provide a single major lobe. This is considered to be attributable to the operating principle such as shown in FIG. 7. In the Figure, a point O indicates the position of the radiator, and numeral 21' designates the same plates as the dielectric plates 21 with only one of the plates being shown in enlarged form. The electromagnetic waves radiated from the point O are shown in terms of geometrical optics. Numerals 5 and 6 indicate the typical electromagnetic waves radiated from the point O, reaching the dielectric plate 21' and then resulting in transmitted waves 7 and 8. Some portions of these electromagnetic waves result in reflected waves 9 and 10. Arrows 11 and 12 indicate the directions which would be followed by the electromagnetic waves 5 and 6 if the dielectric plate 21' were not present and these paths are apparently different from those obtained when there is the dielectric plate 21'. The difference is greater with the electromagnetic wave 6 than with the wave 5. In other words, smaller the angle of incidence to the dielectric plate 21', greater will be the resulting difference. This path difference due to the refraction takes a form which is quite similar to the phase distribution in an endfire array antenna with respect to the phases of the electromagnetic waves observed on the upper surface of the dielectric plate 21' and this is believed to be the cause of the formation of a beam. As a result, smaller the interplate distance d in FIG. 4, smaller will be the angle of incidence of the electromagnetic waves 5 and 6 to the dielectric plate 21' with the result that the endfire characteristic is increased and the side lobe is reduced.

Figure 8:
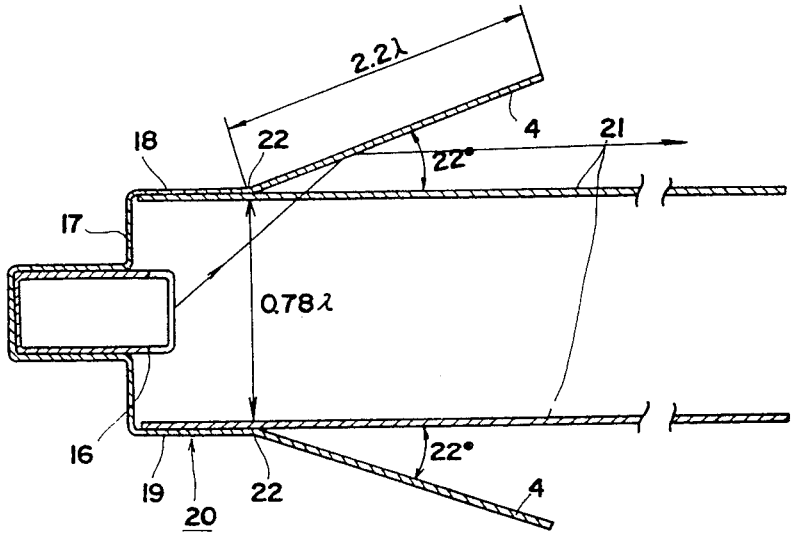
FIG. 8 is an enlarged side sectional view showing the dimensional data of the antenna assembly according to the invention.
Figure 9:
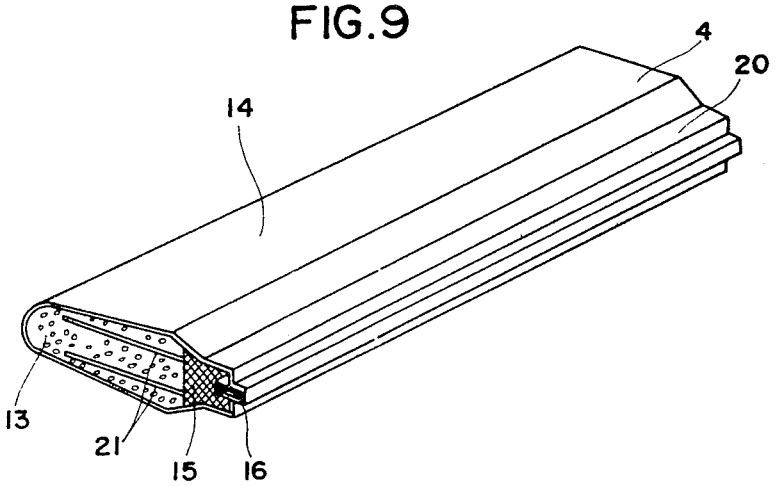
FIG. 9 is a perspective view showing the external appearance of another embodiment of the antenna assembly according to the invention.

Of course, this is the resulting effect of the director mechanism composed of the pair of parallel dielectric plates and such an effect cannot be considered in the case of the device with only one of the plates. In this case, if it is desired to reduce the interplate distance d and thereby to obtain a practical side lobe level, the distance d must inevitably be reduced to less than 0.5λ. This results in reducing the opening length D of the C-shaped member 20 to less than 0.5λ and this results in suppressing the power radiation from the slot waveguide 16. In other words, the opening length D becomes smaller than the cutoff wavelength and the function as the antenna is lost. This fact is believed to have been the cause of the fact that the reflection inducing structure is inevitably arranged in front of the slot waveguide 1 in the construction of the previously proposed slot array antenna assembly of FIG. 1. However, these deficiencies are overcome by the construction of this invention. In other words, it is considered that if, in FIG. 7, the plate thickness t is less than 0.05λ, the reflected power from the dielectric plate 21' is negligibly small and the reflected power returning to the position O of the radiator is reduced further, thus maintaining the frequency characteristic of the slot impedance in a wide band. Further, in accordance with the actually measured radiation patterns shown in FIGS. 5*a* to 5*c*, even in the case of the distance d=0.59λ which is close to 0.5λ, the side lobe level is in the range from −5 to −7 dB and it must be said that this value is far from that desired for practical use. The present invention deals with this problem in accordance with the previously mentioned operating principle so that as shown in FIG. 3 the electromagnetic waves incident to the dielectric plates 21 near to the radiator, that is, the electromagnetic waves incident to the dielectric plates 21 at wide angles are reflected from the metal pent roof plates 4 so that the radiation pattern is corrected and the side lobe level is reduced to a value suitable for practical use. The effects of the metal pent roof plates 4 are truely proved by the actually measured radiation pattern shown in FIG. 6. In this case, the dimensions of the respective components in FIG. 2 are the same as shown in FIG. 8 and the metal pent roof plates 4 have the same upward and downward spread angle of 22° and length of 2.2λ. While, in the described embodiment, the metal pent roof plates 4 are planar in shape, the side lobe reducing effect can be improved by replacing this shape with a hyperboloidal shape having a focus located inside. Further, other curved shapes may also be used so as to vary the radiation pattern in many different ways. Further, from the practical point of view the construction shown in FIG. 3 is not satisfactory in terms of the fragility of the structural strength and thus it is possible to fill the space between the dielectric plates 21 with a foamed dielectric material having a specific inductive capacity of close to 1 so that the distance d between the plates is maintained constant and also the structural strength is ensured. Still further, referring to FIG. 9 showing the external appearance of another embodiment of the device of this invention, a foamed material 13 is arranged to provide a contour line which when viewed from the sides smoothly connects the outer surfaces of the parallel dielectric plates 21 and the forward end edges of metal pent roof plates 4 and the foamed material 13 is covered with a thin sheet 14 of dielectric material from the outside, thus further increasing the structural strength and improving the weathering resistance of the antenna assembly. In FIG. 9, numeral 15 designates a partition wall for suppressing the undesired polarized electromagnetic radiation components when a slot waveguide 16 is of the so-called shunt edge type which also essentially produces orthogonal polarization electromagnetic radiation components, and the partition wall 15 comprises metal blocks or plate materials. In other words, the metal partition wall 15 comprises metal blocks or plates, one for each radiator element, which are arranged to cover the side formed by a C-shaped member 20 and the pair of metal pent roof plates 4 which spread upwardly and downwardly from open end edges 22 of the C-shaped member 20, and the partition wall 15 also serves the function of holding the positions of the slot waveguide 16, the C-shaped member 20, the dielectric plates 21 and the metal pent roof plates 4. While, in the embodiments described above, the slot waveguide has been described as a rectangular waveguide having slots formed in its small surface, it may be replaced with a rectangular waveguide having slots formed in its great surface or a slot radiator comprising any other type of waveguide.

From the foregoing description it will be seen that in accordance with the present invention a slot array antenna assembly is provided in which a structure utilizing dielectric plates effectively as a director mechanism is further provided with metal pent roof plates, thereby reducing the side lobe level to a practically usable value to overcome the deficiencies in the prior art and ensuring reduction in the size and weight and a high degree of performance.

What is claimed is:

1. A slot array antenna assembly comprising:

a member composed of metal wall plates and having a C-shaped side sectional shape;

a slot radiator mounted on a vertical side of said C-shaped member;

a pair of parallel dielectric plates of uniform thickness projected to extend along two parallel sides of said C-shaped member in the direction of the open end thereof, the thickness of each of said dielectric plates being less than about one twentieth of a working wavelength; and a pair of metal flared reflecting plates connected to open end edges of said C-shaped member and arranged to respectively spread upwardly and downwardly.

2. A slot array antenna assembly according to claim 1, wherein each of said metal flared reflecting plates is a plane plate.

3. A slot array antenna assembly according to claim 1, wherein each of said metal flared reflecting plates is a curved plate.

4. A slot array antenna assembly according to claim 1, further comprising partition wall means including a plurality of metal wall blocks or plates arranged to cover a side formed by said C-shaped member and said pair of metal flared reflecting plates spreading upwardly and downwardly from the open end edges of said C-shaped member, each of said metal wall blocks or plates being provided for one of radiator elements of said slot radiator.

5. A slot array antenna assembly according to claim 1, wherein the space between said pair of parallel dielectric plates is filled with a foamed material.

6. A slot array antenna assembly according to claim 1, wherein a foamed material is arranged to provide a contour such that outer sides of said pair of parallel dielectric plates and forward end edges of said pair of metal flared reflecting plates are interconnected smoothly as looked from the sides thereof, and wherein said assembly is covered from the outside of said foamed material with a thin sheet of dielectric material.

* * * * *